US007648210B2

(12) United States Patent
Hall et al.

(10) Patent No.: US 7,648,210 B2
(45) Date of Patent: Jan. 19, 2010

(54) PICK WITH AN INTERLOCKED BOLSTER

(76) Inventors: David R. Hall, 2185 S. Larsen Pkwy., Provo, UT (US) 84606; Scott Dahlgren, 2185 S. Larsen Pkwy., Provo, UT (US) 84606; Jonathan Marshall, 2185 S. Larsen Pkwy., Provo, UT (US) 84606

( * ) Notice: Subject to any disclaimer, the term of this patent is extended or adjusted under 35 U.S.C. 154(b) by 34 days.

(21) Appl. No.: 11/971,965

(22) Filed: Jan. 10, 2008

(65) Prior Publication Data

US 2008/0106139 A1 May 8, 2008

Related U.S. Application Data

(63) Continuation-in-part of application No. 11/947,644, filed on Nov. 29, 2007, which is a continuation-in-part of application No. 11/844,586, filed on Aug. 24, 2007, now Pat. No. 7,600,823, which is a continuation-in-part of application No. 11/829,761, filed on Jul. 27, 2007, which is a continuation-in-part of application No. 11/773,271, filed on Jul. 3, 2007, which is a continuation-in-part of application No. 11/766,903, filed on Jun. 22, 2007, which is a continuation-in-part of application No. 11/766,865, filed on Jun. 22, 2007, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, which is a continuation-in-part of application No. 11/463,953, filed on Aug. 11, 2006, now Pat. No. 7,464,993, application No. 11/971,965, which is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770.

(51) Int. Cl.
*E21C 35/18* (2006.01)

(52) U.S. Cl. ..... 299/104; 299/105; 299/113

(58) Field of Classification Search ..... 299/104, 299/105, 111, 113
See application file for complete search history.

(56) References Cited

U.S. PATENT DOCUMENTS 2,004,315 A 8/1935 Fean (Continued)

*Primary Examiner*—John Kreck
(74) *Attorney, Agent, or Firm*—Tyson J. Wilde; Jad A. Mills

(57) ABSTRACT

In one aspect of the invention, a pick comprises a front portion with an impact tip brazed to a carbide bolster. The carbide bolster comprises a cavity which is formed in the bolster's base end and which is adapted to interlock with a rear portion of the pick. The rear portion is adapted to be retained within a bore of a holder that is attached to a driving mechanism. The rear portion comprises a locking mechanism adapted to lock its first end within the cavity. The locking mechanism comprises a radially extending catch that is formed in the first end of the rear portion.

20 Claims, 11 Drawing Sheets

U.S. PATENT DOCUMENTS 2,124,438 A 7/1938 Struk
3,254,392 A 6/1966 Novkov
3,342,531 A * 9/1967 Krekeler ..... 299/107
3,746,396 A 7/1973 Radd
3,807,804 A 4/1974 Kniff
3,830,321 A 8/1974 McKenry
3,932,952 A 1/1976 Helton
3,945,681 A 3/1976 White
4,005,914 A 2/1977 Newman
4,006,936 A 2/1977 Crabiel
4,093,362 A 7/1978 Bonnice
4,109,737 A 8/1978 Bovenkerk
4,156,329 A 5/1979 Daniels
4,199,035 A 4/1980 Thompson
4,201,421 A 5/1980 Den Besten
4,277,106 A 7/1981 Sahley
4,439,250 A 3/1984 Acharya et al.
4,465,221 A 8/1984 Schmidt
4,484,644 A 11/1984 Cook
4,489,986 A 12/1984 Dziak
4,678,237 A 7/1987 Collin
4,682,987 A 7/1987 Brady
4,688,556 A 8/1987 Elfgen
4,725,098 A 2/1988 Beach
4,729,603 A 3/1988 Elfgen
4,765,686 A 8/1988 Adams
4,765,687 A 8/1988 Parrott
4,776,862 A 10/1988 Wiand
4,880,154 A 11/1989 Tank
4,932,723 A 6/1990 Mills
4,940,288 A 7/1990 Stiffler
4,944,559 A 7/1990 Sionnet
4,951,762 A 8/1990 Lundell
5,011,515 A 4/1991 Frushour
5,112,165 A 5/1992 Hedlund
5,141,289 A 8/1992 Stiffler
5,154,245 A 10/1992 Waldenstrom
5,186,892 A 2/1993 Pope
5,251,964 A 10/1993 Ojanen
5,261,499 A 11/1993 Grubb
5,332,348 A 7/1994 Lemelson
5,417,475 A 5/1995 Graham
5,447,208 A 9/1995 Lund
5,535,839 A 7/1996 Brady
5,542,993 A 8/1996 Rabinkin
5,653,300 A 8/1997 Lund
5,738,698 A 4/1998 Kapoor
5,823,632 A 10/1998 Burkett
5,837,071 A 11/1998 Andersson
5,845,547 A 12/1998 Sollami
5,875,862 A 3/1999 Jurewicz
5,934,542 A 8/1999 Nakamura
5,935,718 A 8/1999 Demo
5,944,129 A 8/1999 Jensen
5,967,250 A 10/1999 Lund
5,992,405 A 11/1999 Sollami
6,006,846 A 12/1999 Tibbitts
6,019,434 A 2/2000 Emmerich
6,044,920 A 4/2000 Massa
6,051,079 A 4/2000 Andersson
6,056,911 A 5/2000 Griffin
6,065,552 A 5/2000 Scott
6,113,195 A 9/2000 Mercier
6,170,917 B1 1/2001 Heinrich
6,193,770 B1 2/2001 Sung
6,196,636 B1 3/2001 Mills
6,196,910 B1 3/2001 Johnson
6,199,956 B1 3/2001 Kammerer
6,216,805 B1 4/2001 Lays
6,270,165 B1 8/2001 Peay
6,341,823 B1 1/2002 Sollami
6,354,771 B1 3/2002 Bauschulte
6,364,420 B1 4/2002 Sollami
6,371,567 B1 4/2002 Sollami
6,375,272 B1 4/2002 Ojanen
6,419,278 B1 7/2002 Cunningham
6,478,383 B1 11/2002 Ojanen
6,499,547 B2 * 12/2002 Scott et al. ..... 175/374
6,517,902 B2 2/2003 Drake
6,585,326 B2 7/2003 Sollami
6,685,273 B1 2/2004 Sollami
6,692,083 B2 2/2004 Latham
6,709,065 B2 3/2004 Peay
6,719,074 B2 4/2004 Tsuda
6,733,087 B2 * 5/2004 Hall et al. ..... 299/113
6,739,327 B2 5/2004 Sollami
6,758,530 B2 7/2004 Sollami
6,786,557 B2 9/2004 Montgomery, Jr.
6,824,225 B2 11/2004 Stiffler
6,851,758 B2 2/2005 Beach
6,854,810 B2 2/2005 Montgomery, Jr.
6,861,137 B2 3/2005 Griffin et al.
6,889,890 B2 5/2005 Yamazaki
6,966,611 B1 11/2005 Sollami
6,994,404 B1 2/2006 Sollami
7,204,560 B2 4/2007 Mercier
2002/0175555 A1 11/2002 Mercier
2003/0141350 A1 7/2003 Noro
2003/0209366 A1 11/2003 McAlvain
2003/0234280 A1 12/2003 Cadden
2004/0026983 A1 2/2004 McAlvain
2004/0065484 A1 4/2004 McAlvain
2005/0159840 A1 7/2005 Lin
2005/0173966 A1 8/2005 Mouthaan
2006/0237236 A1 10/2006 Sreshta

* cited by examiner

PICK WITH AN INTERLOCKED BOLSTER

CROSS REFERENCE TO RELATED APPLICATIONS

This application is a continuation-in-part of U.S. patent application Ser. No. 11/947,644 filed on Nov. 29, 2007, which was a continuation-in-part of U.S. patent application Ser. No. 11/844,586 filed on Aug. 24, 2007 now U.S. Pat. No. 7,600,823. U.S. patent application Ser. No. 11/844,586 is a continuation-in-part of U.S. patent application Ser. No. 11/829,761, which was filed on Jul. 27, 2007. U.S. patent application Ser. No. 11/829,761 is a continuation-in-part of U.S. patent application Ser. No. 11/773,271 which was filed on Jul. 3, 2007. U.S. patent application Ser. No. 11/773,271 is a continuation-in-part of U.S. patent application Ser. No. 11/766,903 filed on Jun. 22, 2007. U.S. patent application Ser. No. 11/766,903 is a continuation of U.S. patent application Ser. No. 11/766,865 filed on Jun. 22, 2007. U.S. patent application Ser. No. 11/766,865 is a continuation-in-part of U.S. patent application Ser. No. 11/742,304 which was filed on Apr. 30, 2007 now U.S. Pat. No. 7,475,948. U.S. patent application Ser. No. 11/742,304 is a continuation of U.S. patent application Ser. No. 11/742,261 which was filed on Apr. 30, 2007 now U.S. Pat. No. 7,469,971. U.S. patent application Ser. No. 11/742,261 is a continuation-in-part of US. patent application Ser. No. 11/464,008 which was filed on Aug. 11, 2006 now U.S. Pat. No. 7,338,135. U.S. patent application Ser. No. 11/464,008 is a continuation-in-part of U.S. patent application Ser. No. 11/463,998 which was filed on Aug. 11, 2006 now U.S. Pat. No. 7,384,105. U.S. patent application Ser. No. 11/463,998 is a continuation-in-part of U.S. patent application Ser. No. 11/463,990 which was filed on Aug. 11, 2006 now U.S. Pat. No. 7,320,505. U.S. patent application Ser. No. 11/463,990 is a continuation-in-part of U.S. patent application Ser. No. 11/463,975 which was filed on Aug. 11, 2006 now U.S. Pat. No. 7,445,294. U.S. patent application Ser. No. 11/463,975 is a continuation-in-part of U.S. patent application Ser. No. 11/463,962 which was filed on Aug. 11, 2006 now U.S. Pat. No. 7,413,256. U.S. patent application Ser. No. 11/463,962 is a continuation-in-part of U.S. patent application Ser. No. 11/463,953, which was also filed on Aug. 11, 2006 now U.S. Pat. No. 7,464,993. The present application is also a continuation-in-part of U.S. patent application Ser. No. 11/695672 which was filed on Apr. 3, 2007 now U.S. Pat. No. 7,396,086. U.S. patent application Ser. No. 11/695672 is a continuation-in-part of U.S. patent application Ser. No. 11/686,831 filed on Mar. 15, 2007 now U.S. Pat. No. 7,568,770. All of these applications are herein incorporated by reference for all that they contain.

BACKGROUND OF THE INVENTION

Formation degradation, such as pavement milling, mining, or excavating, may result in wear on impact resistant picks. Consequently, many efforts have been made to extend the working life of these picks by optimizing the shape of the picks or the materials with which they are made. Examples of such efforts are disclosed in U.S. Pat. No. 4,944,559 to Sionnet et al., U.S. Pat. No. 5,837,071 to Andersson et al., U.S. Pat. No. 5,417,475 to Graham et al., U.S. Pat. No. 6.051,079 to Andersson et al., and U.S. Pat. No. 4,725,098 to Beach, all of which are herein incorporated by reference for all that they contain.

BRIEF SUMMARY OF THE INVENTION

In one aspect of the invention, a pick comprises a front portion with an impact tip brazed to a carbide bolster. The carbide bolster comprises a cavity which is formed in the bolster's base end and which is adapted to interlock with a rear portion of the pick. The rear portion is adapted to be retained within a bore of a holder that is attached to a driving mechanism. The rear portion comprises a locking mechanism adapted to lock its first end within the cavity. The locking mechanism comprises a radially extending catch that is formed in the first end of the rear portion. The locking mechanism may comprise a wedge.

An inside surface of the carbide bolster may comprise a uniform inward taper. In some embodiments the cavity may comprises an inwardly protruding catch. The inwardly protruding catch may be adapted to interlock with the radially extending catch of the first end. An insert may be disposed intermediate the inwardly protruding catch and the radially extending catch. The insert may be a ring, a snap ring, a split ring, or a flexible ring. In some embodiments the insert may be a plurality of balls, wedges, shims or combinations thereof. The inwardly protruding catch may be a hook or a taper. The inwardly protruding catch may form a slot. The radially extending catch may be a hook or a taper. The radially extending catch may form a slot.

The rear portion of the pick may be generally cylindrical. In some embodiments the first end of the rear portion may be a lug. The rear portion may comprise a tensioning mechanism adapted to apply a rear ward force on the first end of the rear portion. The tensioning mechanism may comprise a press fit, a taper, and/or a nut.

The impact tip may comprise a diamond bonded to a carbide substrate. The diamond may comprise a generally conical shape with an apex. A thickness of the diamond at the apex may be 0.100 to 0.500 inches. The diamond may comprise a volume of 75% to 175% of the carbide substrate.

DETAILED DESCRIPTION OF THE INVENTION AND THE PREFERRED EMBODIMENT

Figure 1:
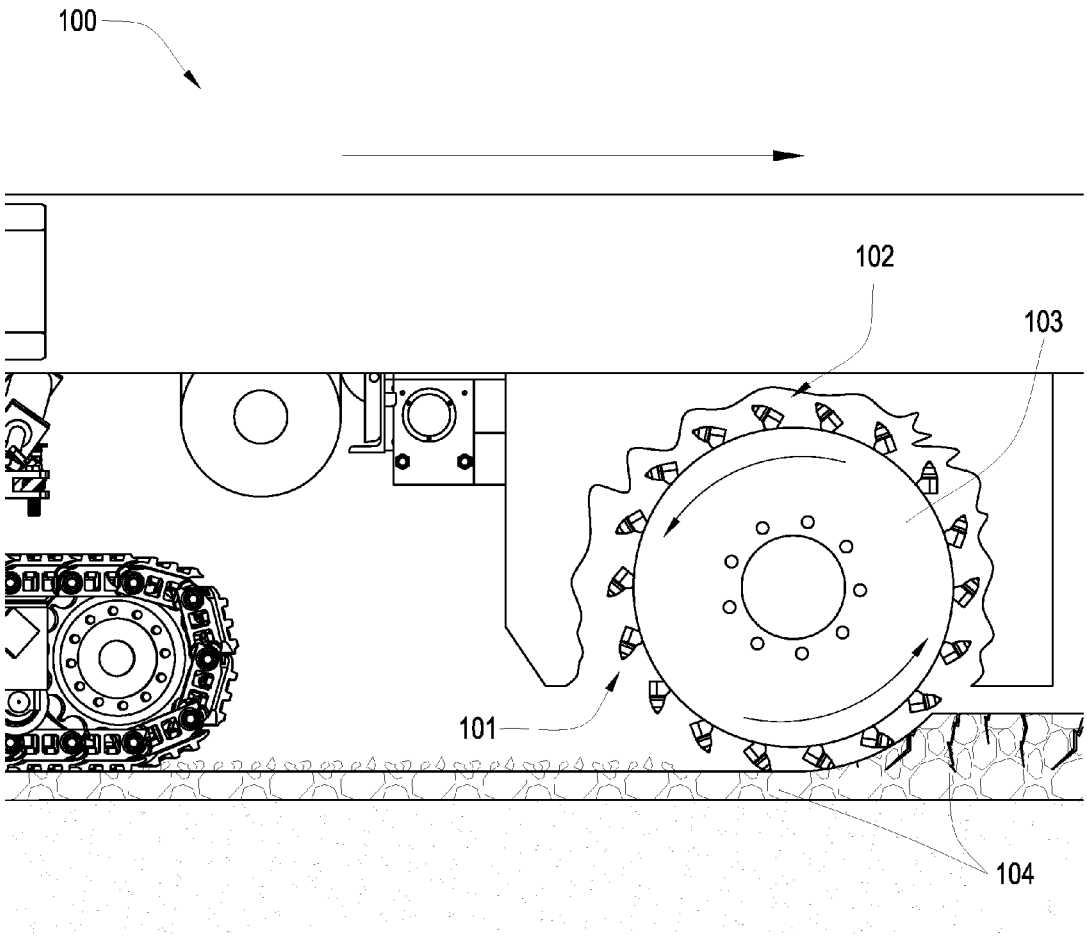
FIG. 1 is a cross-sectional diagram of an embodiment of a milling machine.

FIG. 1 is a cross-sectional diagram of an embodiment of a plurality of picks 101 attached to a driving mechanism 103, such as a rotating drum connected to the underside of a pavement milling machine 100. The milling machine 100 may be a cold planer used to degrade man-made formations such as a paved surface 104 prior to the placement of a new layer of pavement. Picks 101 may be attached to the driving mechanism bringing the picks 101 into engagement with the formation. A holder 102, which may be a block, an extension in the block or a combination thereof, is attached to the driving mechanism 103, and the pick 101 is inserted into the holder 102. The holder 102 may hold the pick 101 at an angle offset from the direction of rotation, such that the pick 101 engages the pavement at a preferential angle. In addition to milling machines, the pick 101 may be adapted for use in a downhole rotary drill bit, in a horizontal directional drill bit, in trenching machines, in mining machines, and in coal mining machines. Each pick 101 may be designed for high-impact resistance and long life while milling the paved surface 104.

Figure 2:
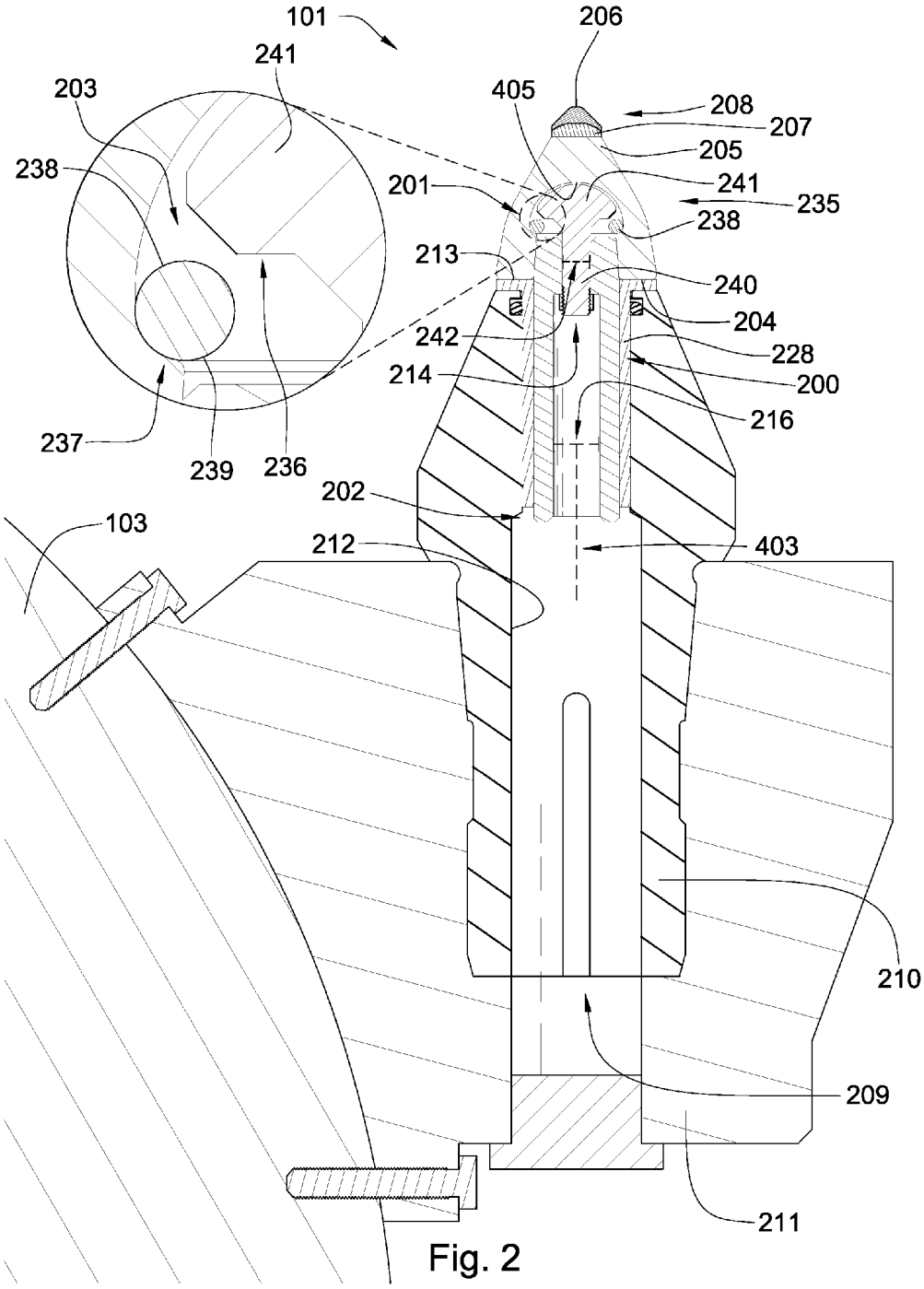
FIG. 2 is a cross-sectional diagram of an embodiment of an impact resistant pick.

Referring now to FIG. 2 the pick 101 comprises a rear portion 200 comprising first and second ends 201, 202, and a front portion 235. The front portion 235 comprises an impact tip 208 that is brazed to a carbide bolster 205. The bolster 205 is adapted to interlock with the rear portion 200. The first end 201 of the rear portion 200 may be press fit into a cavity 203 in a base end 204 of a cemented metal carbide bolster 205. A super hard material 206 may be bonded to a cemented metal carbide substrate 207 to form the impact tip 208, which may then be bonded to the bolster 205 opposite the base end 204 of the bolster 205, and opposite the first end 201 of the rear portion 200. In FIG. 2 the rear portion 200 is generally cylindrical. The second end 202 of the rear portion 200 is disposed within a bore 209 of a holder 102, which may comprise an extension 210, a block 211 attached to the driving mechanism 103, or both.

An outer surface of the holder 102 may comprise hard-facing in order to provide better wear protection for the holder 102. The hard-facing may comprise ridges after it is applied, though the ridges may be machined down afterward. In the present embodiment a sleeve 228 is disposed intermediate the pick 101 and the holder 102. In some embodiments the base end 204 of the bolster 205 may be in direct contact with an upper face 213 of the holder 102, and may overhang the holder 102 and hard-facing, which may prevent debris from collecting on the upper face 213. The bore 209 of the holder 102 may comprise hard-facing. One method of hard-facing the bore is case-hardening, during which process the bore is enriched with carbon and/or nitrogen and then heat treated, which hardens the bore and provides wear protection, although other methods of hard-facing the bore may also be used. The rear portion 200 is adapted to be retained within the bore 209.

The rear portion 200 may comprise a hard material such as steel, stainless steel, hardened steel, or other materials of similar hardness. The bolster 205 may comprise tungsten, titanium, tantalum, molybdenum, niobium, cobalt and/or combinations thereof. The super hard material 206 may be a material selected from the group consisting of diamond, monocrystalline diamond, polycrystalline diamond, sintered diamond, chemical deposited diamond, physically deposited diamond, natural diamond, infiltrated diamond, layered diamond, thermally stable diamond, silicon-bonded diamond, metal-bonded diamond, silicon carbide, cubic boron nitride, and combinations thereof.

The rear portion 200 may be work-hardened or cold-worked in order to provide resistance to cracking or stress fractures due to forces exerted on the pick by the paved surface 104 or the holder 102. The rear portion 200 may be work-hardened by shot-peening or by other methods of work-hardening. The rear portion 200 may also be rotatably held into the holder 102, such that the pick 101 is allowed to rotate within the holder 102. At least a portion of the rear portion may also be work-hardened by stretching it during the manufacturing process.

The first end 201 of the rear portion 200 protrudes into the cavity 203 in the base end 204 of the bolster 205 and also comprises a locking mechanism 214. The locking mechanism 214 is adapted to lock the first end 201 of the rear portion 200 within the cavity 203. The locking mechanism 214 may attach the rear portion 200 to the carbide bolster 205 and restrict movement of the rear portion 200 with respect to the carbide bolster 205. The locking mechanism comprises a radially extending catch 236 that is formed in the first end 201 of the rear portion 200. The rear portion 200 may be prevented by the locking mechanism 214 from moving in a direction parallel to a central axis 403 of the pick 101. In some embodiments the rear portion 200 may be prevented by the locking mechanism 214 from rotating about the central axis 403.

In FIG. 2 the cavity 203 comprises an inwardly protruding catch 237. An insert 238 is disposed intermediate the inwardly protruding catch 237 of the cavity 203 and the radially extending catch 236 of the first end 201. In the present embodiment the insert 238 is a flexible ring 239. In some embodiments the insert 238 may be a ring, a snap ring, a split ring, coiled ring, a flexible ring 239 or combinations thereof In FIG. 2 the locking mechanism 214 comprises a locking shaft 240. The locking shaft 240 is connected to an expanded locking head 241. In the present embodiment the radially extending catch 236 is an undercut formed in the locking head 241. The insert 238 and locking head 241 are disposed within the cavity 203 of the carbide bolster 205. The locking shaft 240 protrudes from the cavity 203 and into an inner diameter 216 of the rear portion 200. The locking shaft 240 is disposed proximate a constricted inner diameter 242 proximate the first end 201 of the rear portion 200. The locking shaft 240 is adapted for translation in a direction parallel to the central axis 403 of the rear portion 200. The locking shaft 240 may extend from the cavity 203 and the insert 238 may be inserted into the cavity 203.

When the first end 201 of the rear portion 200 is inserted into the cavity 203, the locking head 241 may be extended away from the constricted inner diameter 242 of the rear portion 200. The insert 238 may be disposed around the locking shaft 240 and be intermediate the locking head 241 and the constricted inner diameter 242. The insert 238 may comprise stainless steel. In some embodiments the insert 238 may comprise an elastomeric material and may be flexible. The insert 238 may be a ring, a snap ring, a split ring, a coiled ring, a rigid ring, segments, balls, shims, or combinations thereof Referring now to FIG. 2*a*, the insert 238 may comprise a breadth 244 that is larger than an opening 243 of the cavity 203. In such embodiments the insert 238 may compress to have a smaller breadth 244 than the opening 243. Once the insert 238 is past the opening 243, the insert 238 may expand to comprise its original or substantially original breadth 244. With both the insert 238 and the locking head 241 inside the cavity 203, the rest of the first end 201 of the rear portion 200 may be inserted into the cavity 203 of the bolster 205. Once the entire first end 201 of the rear portion 200 is inserted into the cavity 203 to a desired depth, a nut 245 may be threaded onto an exposed end 246 of the locking shaft 240 until the nut 245 contacts a ledge 247 proximate the constricted inner diameter 242. This contact and further threading of the nut 245 on the locking shaft 240 may cause the locking shaft 240 to move toward the second end 202 of the rear portion 200 in a direction parallel to the central axis 403 of the rear portion 200. This may also result in bringing the radially extending catch 236 of the locking head 240 into contact with the insert 238, and bringing the insert 238 into contact with the inwardly protruding catch 237 of the cavity 203. The nut 245 is an embodiment of a tensioning mechanism 247. The tensioning mechanism 247 is adapted to apply a rearward force on the first end 201 of the rear portion 200. The rearward force may pull the first end 201 of the rear portion 200 in the direction of the second end 202. In some embodiments the tensioning mechanism 247 may comprise a press fit, a taper, and/or a nut 245.

Once the nut is threaded tightly onto the locking shaft 240, the locking head 241 and insert 238 are together too wide to exit the opening 243. In some embodiments the contact between the locking head 241 and the bolster 205 via the insert 238 may be sufficient to prevent both rotation of the rear portion 200 about its central axis 403 and movement of the rear portion in a direction parallel to its central axis 403. In the present embodiment the locking mechanism 214 is also adapted to inducibly release the rear portion 200 from attachment with the carbide bolster 205 by removing the nut 245 from the locking shaft 240.

In the present embodiment the insert 238 may be a snap ring. The insert may comprise stainless steel and may be deformed by the pressure of the locking head 241 being pulled towards the second end 202 of the rear portion 200. As the insert 238 deforms is may become harder. The deformation may also cause the insert 238 to be complementary to both the inwardly protruding catch 237 and the radially extending catch 236. This dually complementary insert 238 may avoid point loading or uneven loading, thereby equally distributing contact stresses. In such embodiments the insert 238 may be inserted when it is comparatively soft, and then may be work hardened while in place proximate the catches 236, 237.

In some embodiments at least part of the rear portion 200 of the pick 101 may also be cold worked. The rear portion 200 may be stretched to a critical point just before the strength of the rear portion 200 is compromised. In the present embodiment, the locking shaft 240, locking head 241, and insert 238 may all be cold worked by tightening the nut 245 until the locking shaft and head 240, 241, and the insert 238, reach a stretching critical point. During this stretching the insert 238, and the locking shaft and head 240, 241, may all deform to create a complementary engagement, and may then be hardened in that complementary engagement. In some embodiments the complementary engagement may result in an interlocking between the radially extending catch 236 and the inwardly protruding catch 237.

Figure 2A:
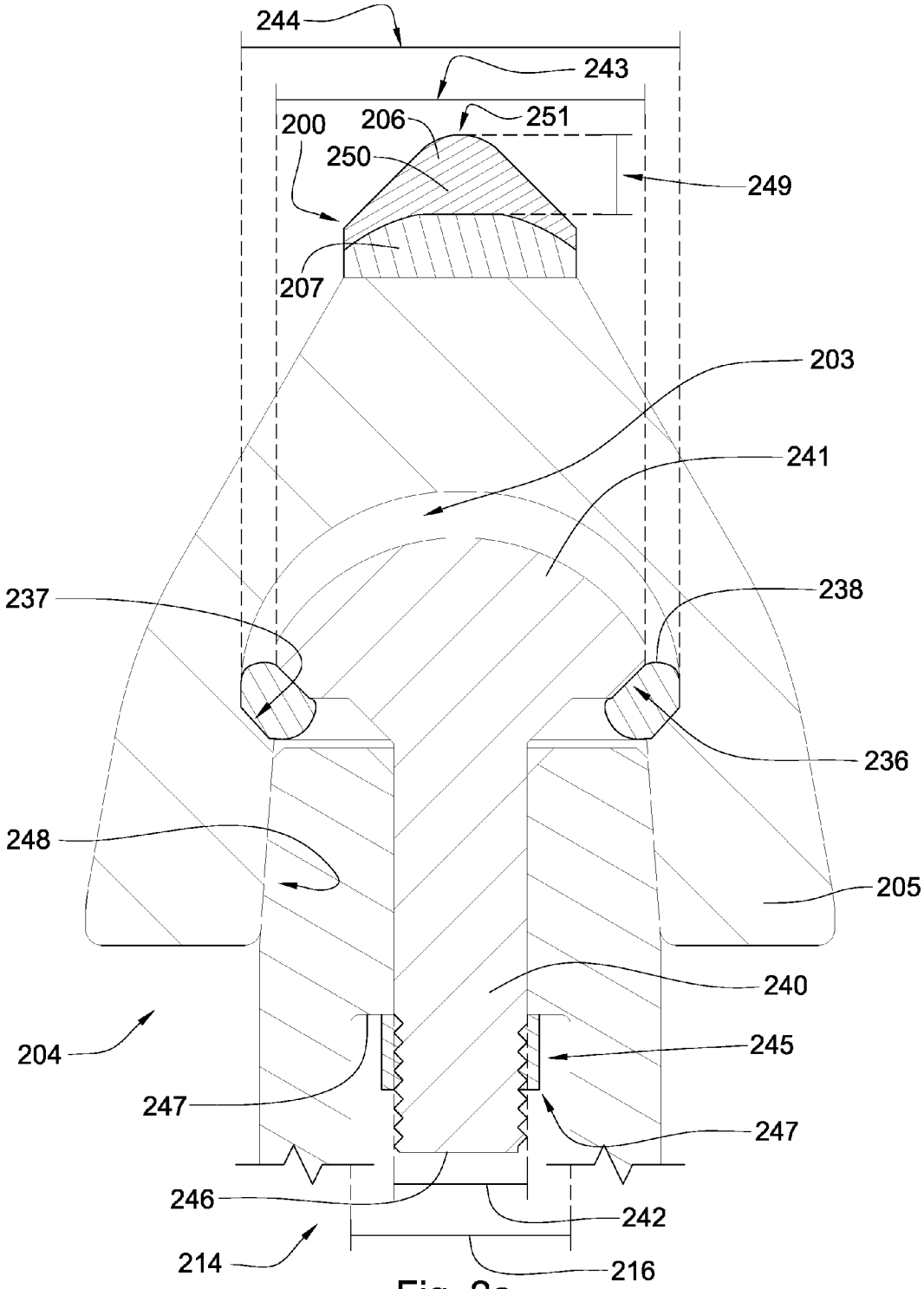
FIG. 2*a* is a cross-sectional diagram of another embodiment of a pick.

In the embodiment of FIG. 2*a*, both the inwardly protruding catch 237 and the radially extending catch 236 are tapers. Also in FIG. 2*a*, the base end 204 of the bolster 205 comprises a uniform inward taper 248. The impact tip 208 in FIG. 2*a* comprises a diamond 250 bonded to the carbide substrate 207. In some embodiments the diamond 250 may comprise a volume that is 75% to 175% of a volume of the carbide substrate 207.

The diamond is an embodiment of a superhard material 206 and comprises a generally conical shape with an apex 251. The thickness 249 of the diamond at the apex 251 may be 0.100 to 0.500 inches. The cemented metal carbide substrate 207 may comprise a height of 0.090 to 0.250 inches. The superhard material 206 bonded to the substrate 207 may comprise a substantially pointed geometry with an apex comprising a 0.050 to 0.160 inch radius. Preferably, the interface between the substrate 207 and the superhard material 206 is non-planar, which may help distribute loads on the tip 208 across a larger area of the interface. The side wall of the superhard material may form an included angle with a central axis of the tip between 30 to 60 degrees. In asphalt milling applications, the inventors have discovered that an optimal included angle is 45 degrees, whereas in mining applications the inventors have discovered that an optimal included angle is between 35 and 40 degrees. A tip that may be compatible with the present invention is disclosed in U.S. patent application Ser. No. 11/673,634 to Hall and is currently pending.

The impact tip 208 may be brazed onto the carbide bolster 205 at a braze interface. Braze material used to braze the tip 208 to the bolster 205 may comprise a melting temperature from 700 to 1200 degrees Celsius; preferably the melting temperature is from 800 to 970 degrees Celsius. The braze material may comprise silver, gold, copper nickel, palladium, boron, chromium, silicon, germanium, aluminum, iron, cobalt, manganese, titanium, tin, gallium, vanadium, phosphorus, molybdenum, platinum, or combinations thereof. The braze material may comprise 30 to 62 weight percent palladium, preferable 40 to 50 weight percent palladium. Additionally, the braze material may comprise 30 to 60 weight percent nickel, and 3 to 15 weight percent silicon; preferably the braze material may comprise 47.2 weight percent nickel, 46.7 weight percent palladium, and 6.1 weight percent silicon. Active cooling during brazing may be critical in some embodiments, since the heat from brazing may leave some residual stress in the bond between the carbide substrate 207 and the super hard material 206. The farther away the super hard material is from the braze interface, the less thermal damage is likely to occur during brazing. Increasing the distance between the brazing interface and the super hard material 206, however, may increase the moment on the carbide substrate 207 and increase stresses at the brazing interface upon impact. The rear portion 200 may be press fitted into the bolster 205 before or after the tip 208 is brazed onto the bolster 205.

Figure 3:
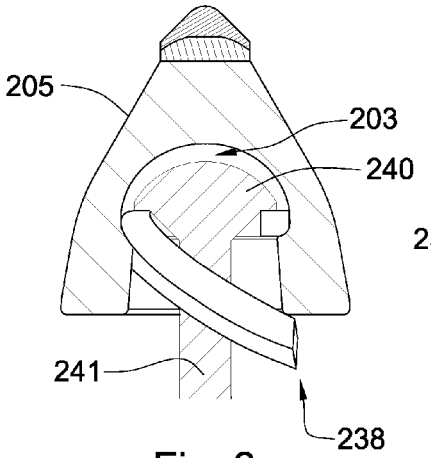
FIG. 3 is a cross-sectional diagram of another embodiment of a pick.
Figure 4:
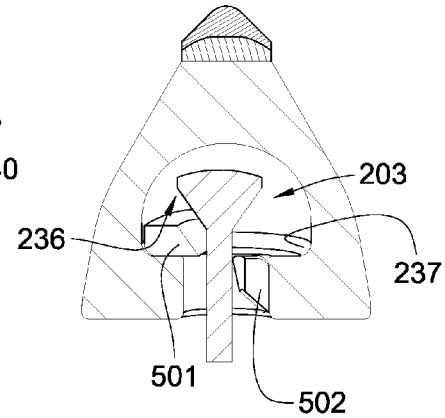
FIG. 4 is a cross-sectional diagram of another embodiment of a pick.
Figure 5:
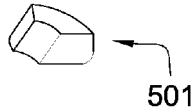
FIG. 5 is a perspective diagram of an embodiment of a wedge.

Referring now to FIGS. 3-12, a variety of inserts 238 are disclosed. In FIG. 3, a flexible insert 238 is being inserted into the cavity 203 while the locking shaft and head 240, 241 are already inside the cavity 203. In FIG. 4, a wedge 501 is disposed within the cavity intermediate the inwardly protruding and radially extending catches 237, 236. FIG. 5 discloses a perspective view of an embodiment of a wedge 501. In some embodiments of the invention, the insert 238 may be one or more wedges 501. One wedge may be already present in the cavity 203 when the locking head 241 is inserted into the cavity 203. Additional wedges 502 may be inserted into the cavity 203 while the locking head 241 is already present in the cavity 203.

Figure 6:
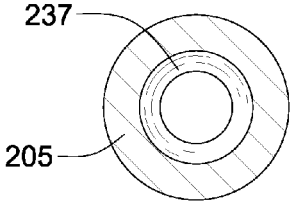
FIG. 6 is a cross-sectional diagram of another embodiment of a pick.
Figure 7:
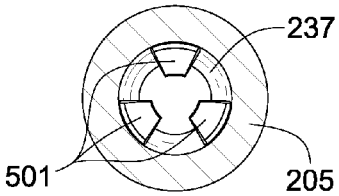
FIG. 7 is a cross-sectional diagram of another embodiment of a pick.
Figure 8:
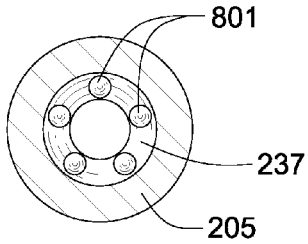
FIG. 8 is a cross-sectional diagram of another embodiment of a pick.

FIGS. 6-8 disclose top-view cross-sectional diagrams of carbide bolsters 205. In FIG. 6 the inwardly protruding catch 237 is visible. In FIG. 7 a plurality of wedges 501 are disposed on the inwardly protruding catch 237. In FIG. 8, a plurality of balls 801 is disposed on the inwardly protruding catch 237. The insert 238 may be a plurality of balls 801, wedges 501, shims, or combinations thereof.

Figure 9:
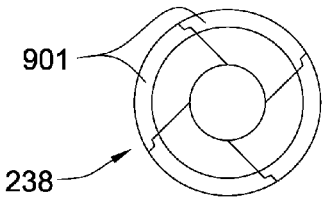
FIG. 9 is a perspective diagram of an embodiment of an insert.
Figure 10:
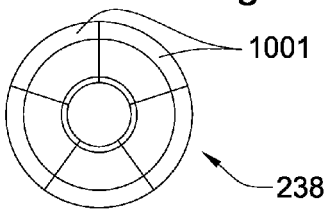
FIG. 10 is a perspective diagram of another embodiment of an insert.
Figure 11:
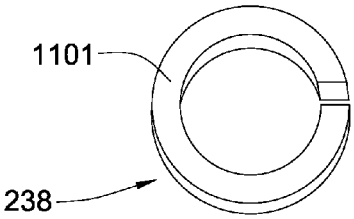
FIG. 11 is a perspective diagram of another embodiment of an insert.
Figure 12:
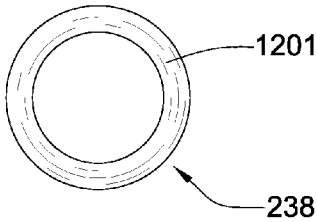
FIG. 12 is a perspective diagram of another embodiment of an insert.

FIGS. 9-12 disclose various embodiments of inserts 238. FIG. 9 discloses an insert 238 comprising a plurality of interlocked segments 901. FIG. 10 discloses an insert 238 comprising a plurality of abutting segments 1001. FIG. 11 discloses an embodiment of an insert 238 that is a snap ring 1101. FIG. 12 discloses an embodiment in which the insert 238 is a ring 1201. In some embodiments the ring 1201 may be flexible.

Figure 13:
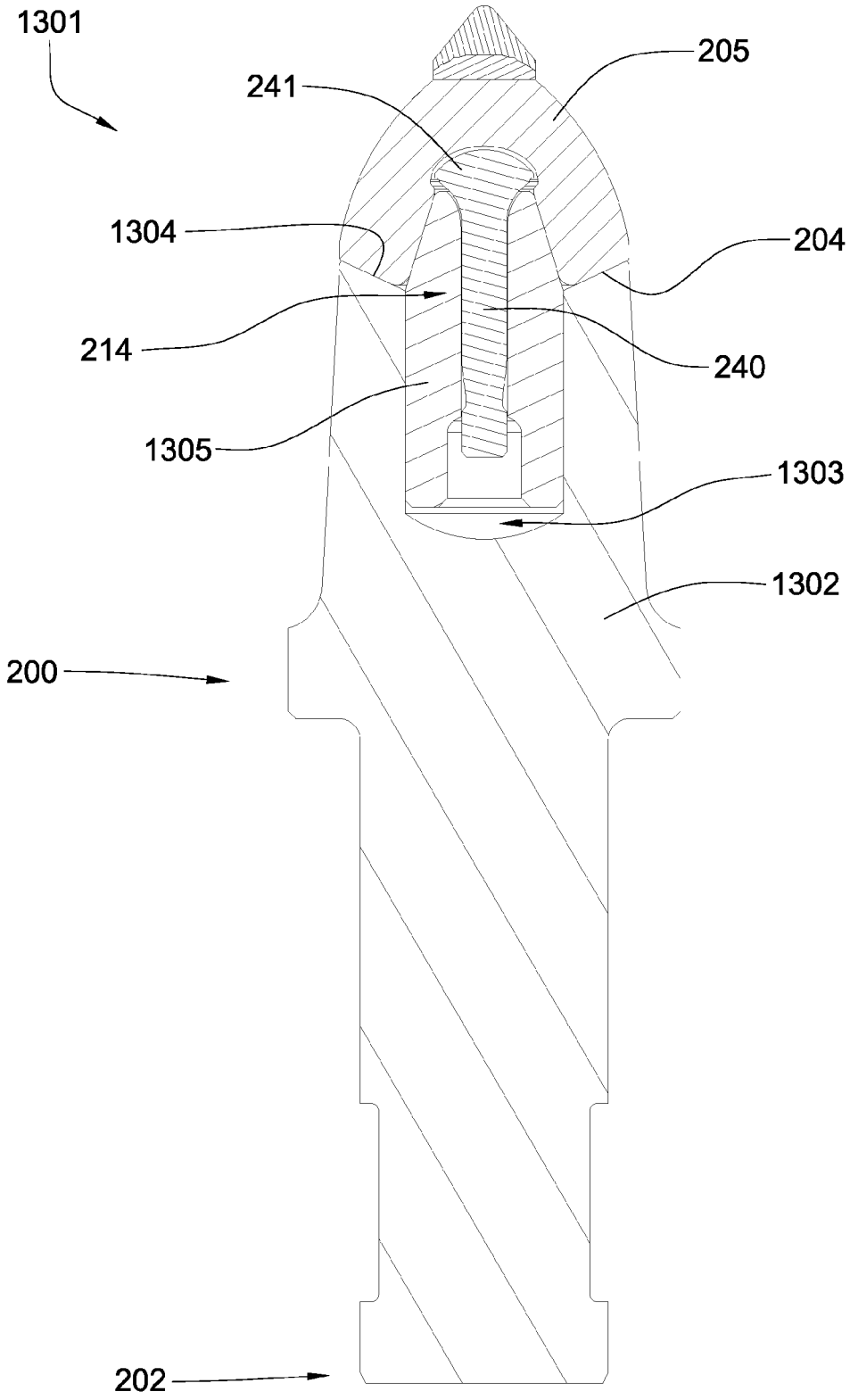
FIG. 13 is a cross-sectional diagram of an embodiment of a mining pick.

Referring now to FIG. 13, an embodiment of a mining pick 1301 is disclosed. The mining pick 1301 comprises a steel body 1302 disposed intermediate the carbide bolster 205 and the rest of the rear portion 200. The rear portion 200 may comprise a locking mechanism 214, a shaft sleeve 1305, the steel body 1302, and may continue to the second end 202 of the pick 101. The steel body 1302 comprises a central recess 1303, and a distal surface 1304 of the steel body 1302 is in contact with the base end 204 of the carbide bolster 205. The locking shaft 240 is disposed within the shaft sleeve 1305, and the shaft sleeve 1305 is press fit into the central recess 1303 of the steel body 1302. The shaft sleeve 1305 may also be brazed or otherwise connected to the steel body 1302. In some embodiments the locking head 241 may be inserted into the cavity 203 of the carbide bolster 205 before inserting the locking shaft 240 into the shaft sleeve 1305. In such embodiments the shaft sleeve 1305 may then subsequently be press fit into the steel body 1302, or the shaft sleeve 1305 may already be press fit into the steel body 1302.

Figure 14:
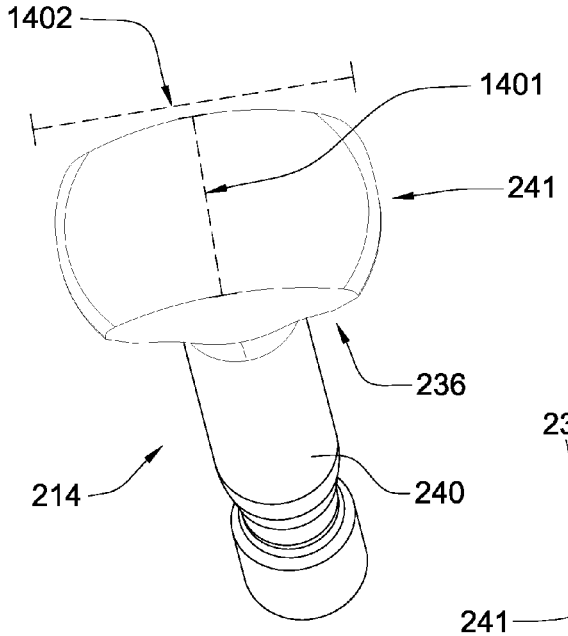
FIG. 14 is a perspective diagram of an embodiment of locking mechanism.
Figure 15:
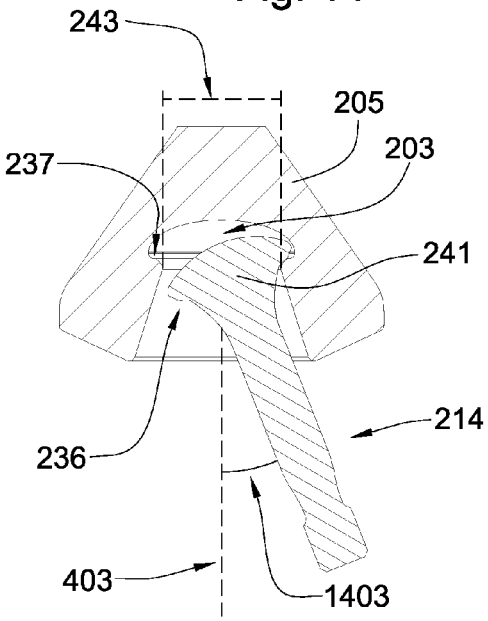
FIG. 15 is a cross-sectional diagram of a locking mechanism and a bolster.
Figure 16:
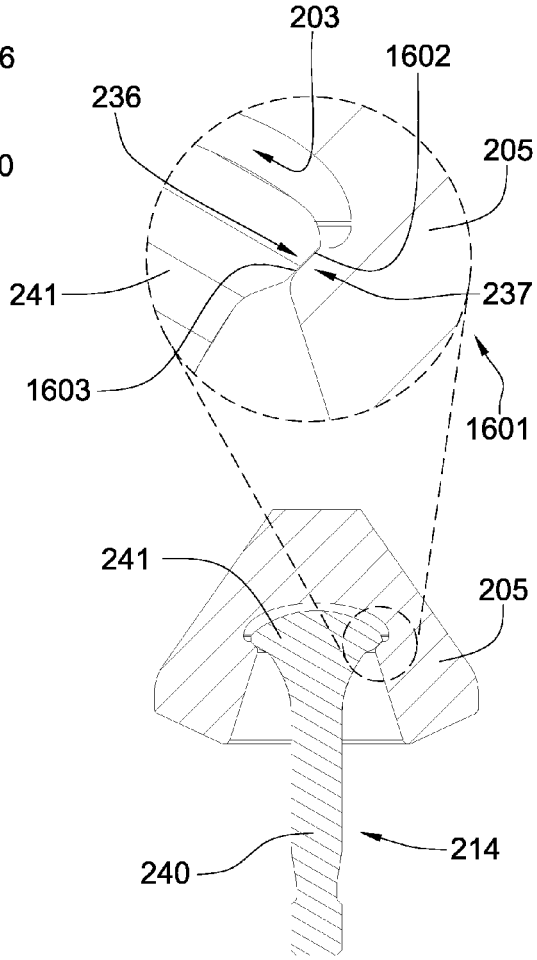
FIG. 16 is a cross-sectional diagram of a locking mechanism and a bolster.

Referring now to FIGS. 14-16, an embodiment of a locking mechanism 214 is disclosed. The locking mechanism 214 comprises a radially extending catch 236. The cavity 203 of the carbide bolster 205 comprises an inwardly protruding catch 237. The locking mechanism 214 also comprises a locking head 241 having a short diameter 1401 and a long diameter 1402. The short diameter 1401 is smaller than the opening 243 of the cavity 203 and allows the locking head 241 to be inserted into the cavity 203 while held at an angle 1403 to the central axis 403 of the pick 101. FIG. 16 discloses the locking head 241 fully placed within the cavity 203 and the locking shaft 240 positioned parallel to the central axis 403 of the pick 101. An enlarged view 1601 shows the radially extending catch 236 of the locking head 241 and the inwardly protruding catch 237 of the cavity 203 comprising complementary tapers 1602, 1603.

Figure 17:
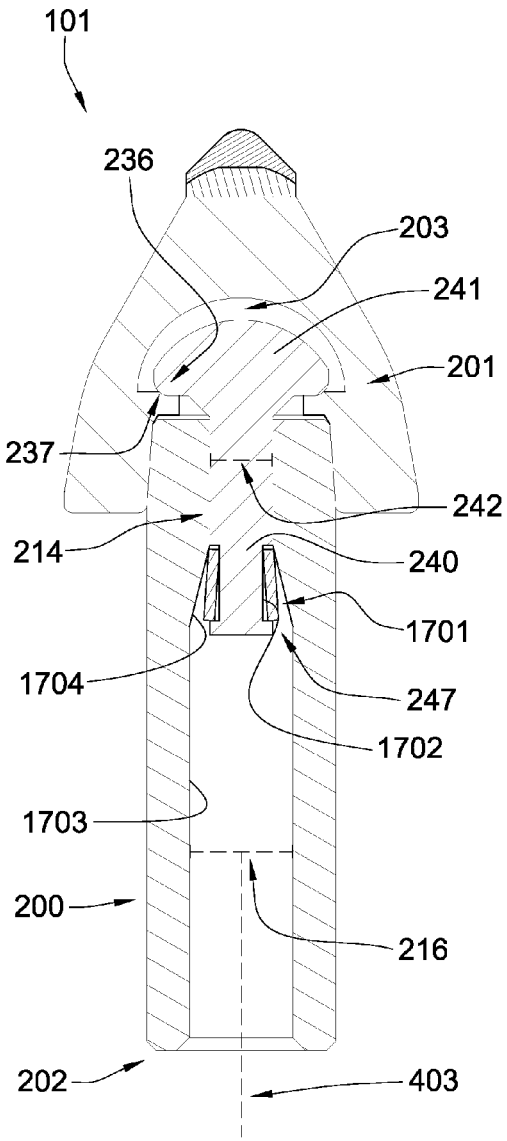
FIG. 17 is a cross-sectional diagram of another embodiment of a pick.

Referring now to FIG. 17, an embodiment of a pick 101 is disclosed in which the tensioning mechanism 247 comprises a retaining clip 1701 adapted to fit in an inset portion 1702 of the locking shaft 240. An interior surface 1703 of the rear portion 200 of the pick 101 comprises a transition taper 1704 intermediate the constricted inner diameter 242 and the inner diameter 216. The retaining clip 1701 may be adapted to expand away from the central axis 403 of the pick 101. As the retaining clip 1701 expands it may press against the transition taper 1704, thereby causing a resultant tension on the locking shaft 240 directed towards the second end 202 of the rear portion 200.

Figure 18:
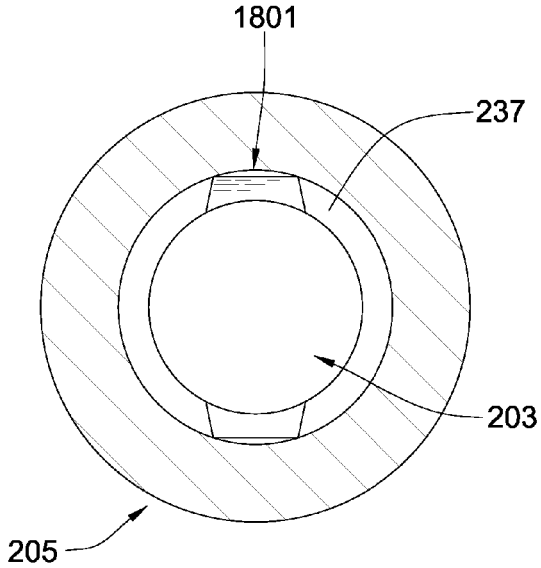
FIG. 18 is a cross-sectional diagram of another embodiment of a pick.
Figure 19:
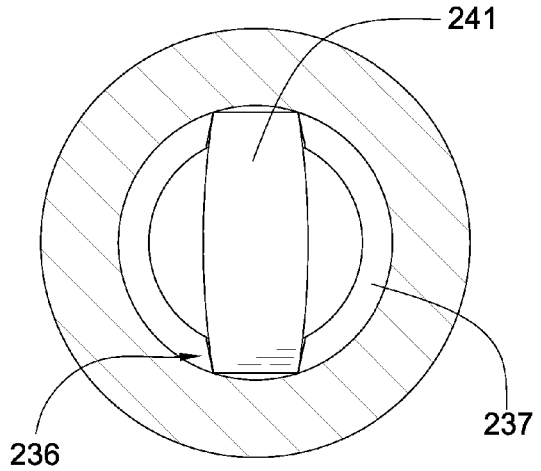
FIG. 19 is a cross-sectional diagram of another embodiment of a pick.

Referring now to FIGS. 17-19, embodiments are disclosed in which the inwardly protruding catch 237 of the cavity 203 is adapted to interlock with the radially extending catch 236 of the locking mechanism 214 proximate the first end 201 of the rear portion 200. In FIG. 18 an inwardly protruding catch 237 that forms a seat 1801 is disclosed. The seat 1801 is recessed from the rest of the inwardly protruding catch 237. In FIG. 19 the radially extending catch 236 of the locking head 241 is shown interlocked with the inwardly protruding catch 237 by being placed in the seat 1801.

Figure 20:
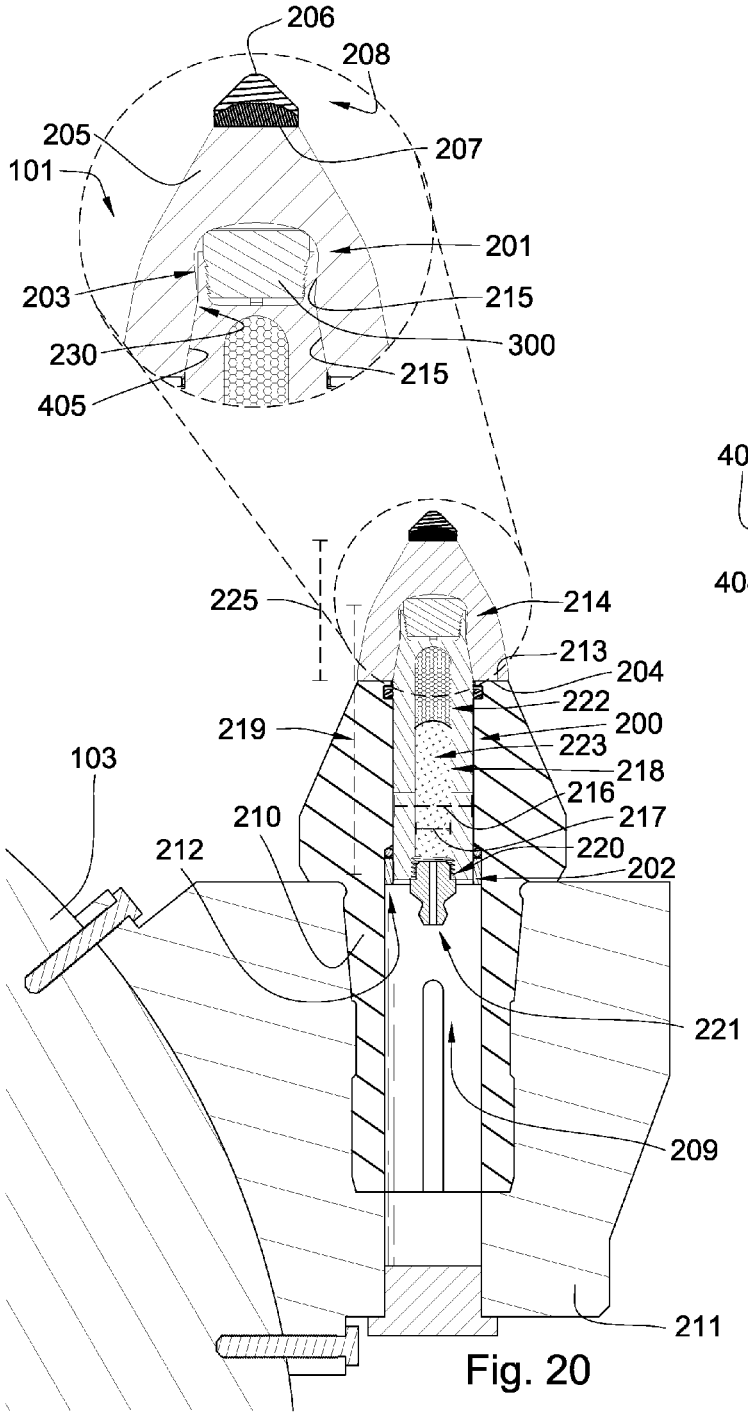
FIG. 20 is a cross-sectional diagram of an embodiment of a pick attached to a driving mechanism
Figure 21:
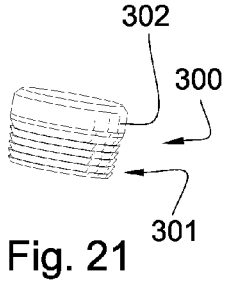
FIG. 21 is a perspective diagram of an embodiment of a wedge.
Figure 22:
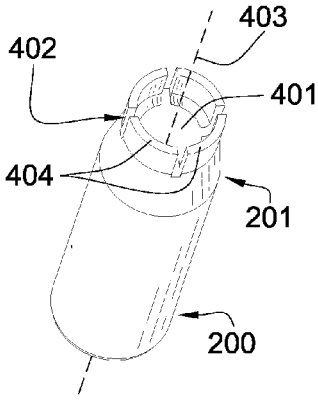
FIG. 22 is a perspective diagram of an embodiment of a rear portion of a pick.

Referring now to FIGS. 20-22, the locking mechanism 214 radially expands at least part of the rear portion 200 outward to engage the cavity 203 of the carbide bolster 205. This engagement may attach the rear portion 200 to the carbide bolster 205, thereby preventing movement of the rear portion 200 with respect to the carbide bolster 205. In the present embodiment the locking mechanism 214 comprises a wedge 300 that is disposed within the cavity 203. FIG. 21 is a perspective diagram of an embodiment of a wedge 300 comprising ridges 301 along a portion of an outside surface 302 of the wedge 300. FIG. 22 is a perspective diagram of an embodiment of the first end 201 of a rear portion 200. The first end 201 comprises a pocket 401 into which the wedge 300 may be inserted. As the rear portion 200 is inserted into the cavity 203, the wedge 300 is forced into the pocket 401 of the first end 201, and thereby an expandable portion 402 of the first end 201 is forced outward, away from the central axis 403 of the rear portion 200, and into engagement with an internal surface 405 of the carbide bolster 205 in the cavity 203. Although in the present embodiment the expandable portion 402 of the first end 201 comprises a plurality of prongs 404, in some embodiments the expandable portion 402 may extend continuously along a diameter of the rear portion 200.

In FIG. 20 the internal surface 405 of the cavity 203 comprises an intersection 230 of two outwardly tapered surfaces 215 and the cavity 203 comprises a generally hour-glass shaped geometry. The rear portion comprises inner and outer diameters 216, 217. A hollow portion 218 of the rear portion 200 is disposed within the inner diameter 216 along at least part of a length 219 of the rear portion 200. The rear portion 200 also comprises a hollow portion 218. In FIG. 20, access to the hollow portion 218 is controlled by a one-way check valve 221. A lubricant reservoir 223 is disposed in the hollow portion 218 intermediate the check valve 221 and a piston assembly 222.

The pick 101 may be lubricated by inserting a lubricant into the reservoir 223 through the bore 209 of the holder 102 and through the one-way valve 221. The piston assembly 222 may be disposed within the bore 209 such that as more lubricant is inserted into the bore 209, the piston assembly 222 may compress to allow the lubricant to be inserted. After the lubricant is inserted into the bore 209, the piston assembly 222 may apply pressure on the lubricant, which may force it up around the rear portion 200 and out of the holder 102. This may allow the pick 101 to rotate more easily and may decrease friction while the pick rotates for better wear protection of areas in contact with the holder 102, such as the base end 204 of the bolster 205 and the rear portion 200.

A weeping seal may be disposed around the rear portion 200 such that it is in contact with the rear portion 200, the bolster 205, and the holder 102, which may limit the rate at which the lubricant is expelled from the bore 209. The lubricant may also be provided from the driving mechanism. In embodiments, where the driving mechanism is a drum, the drum may comprise a lubrication reservoir and a port may be formed in the drum which leads to the lubrication reservoir. In some embodiments a spiral groove may be formed in the rear portion 200 or the bore 209 of the holder 102 to aid in exposing the surfaces of the rear portion 200 and the holder bore to the lubricant. In some embodiments, the lubricant is added to the bore 209 of the holder 102 prior to securing the rear portion 200 within the holder 102. In such an embodiment, the insertion of the rear portion 200 may penetrate the volume of the lubricant forcing a portion of the volume to flow around the rear portion 200 and also compressing the lubricant within the bore.

Dimensions of the rear portion 200 and bolster 205 may be important to the function and efficiency of the pick 101. A ratio of a length 219 of the rear portion 200 to a length 225 of the bolster 205 may be from 1.75:1 to 2.5: 1. A ratio of a maximum width of the bolster 205 to the outer diameter 217 of the rear portion 200 may be from 1.5:1 to 2.5:1. The first end 201 of the rear portion 200 may be fitted into the cavity 203 of the bolster 205 to a depth of 0.300 to 0.700 inches. The cavity 203 of the bolster 205 may comprise a depth from 0.600 to 1 inch. The rear portion 200 may or may not extend into a full depth of the cavity 203. The rear portion 200 and bolster 205 may also comprise an interference fit from 0.0005 to 0.005 inches. The bolster may comprise a minimum cross-sectional thickness between the internal surface 405 of the cavity 203 and an outside surface of the bolster 205 of 0.200 inches, preferable at least 0.210 inches. Reducing the volume of the bolster 205 may advantageously reduce the cost of the pick 101.

Figure 23:
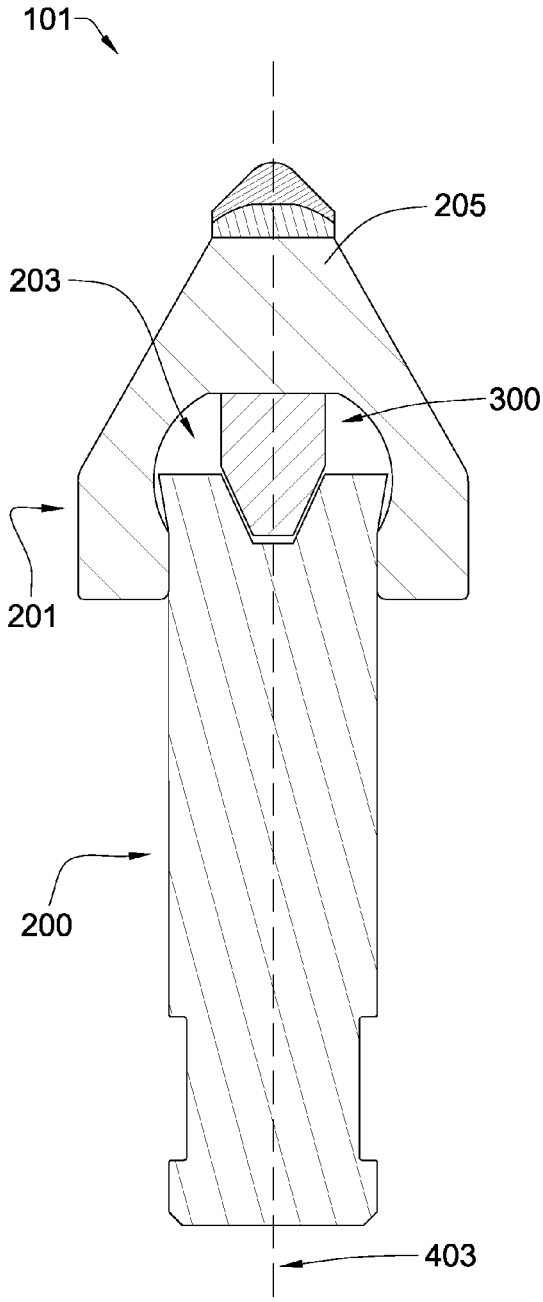
FIG. 23 is a cross-sectional diagram of another embodiment of a pick.
Figure 24:
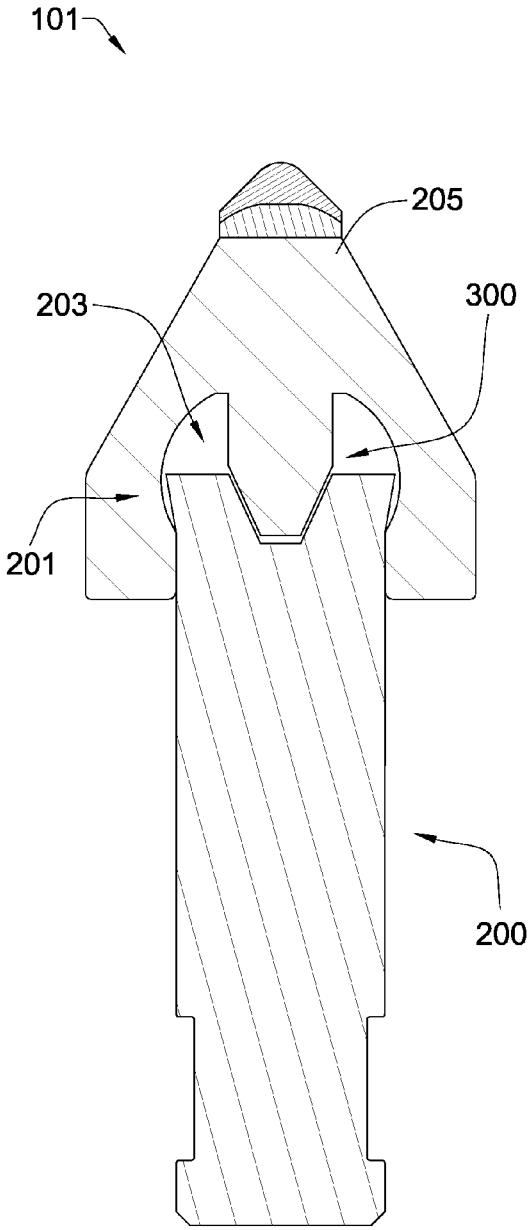
FIG. 24 is a cross-sectional diagram of another embodiment of a pick.

Referring now to FIGS. 23 and 24, the first end 201 of the rear portion 200 is adapted to expand when a wedge 300 is inserted into the first end 201. The insertion of the wedge 300 into the first end 201 may coincide with insertion of the rear portion 200 into the cavity 203. The expansion of the first end 201 away from the central axis 403 of the rear portion 200 may strengthen the attachment between the bolster 205 and the rear portion 200. In FIG. 24 an embodiment is disclosed in which the wedge 300 is fixed to the carbide bolster 205.

Figure 25:
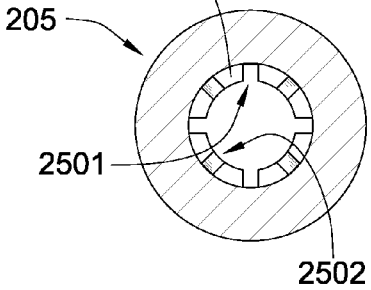
FIG. 25 is a cross-sectional diagram of another embodiment of a pick.
Figure 26:
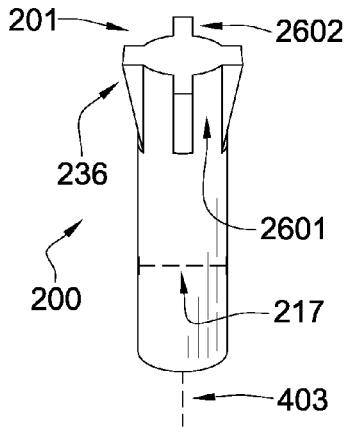
FIG. 26 is a perspective diagram of another embodiment of a rear portion of a pick.
Figure 27:
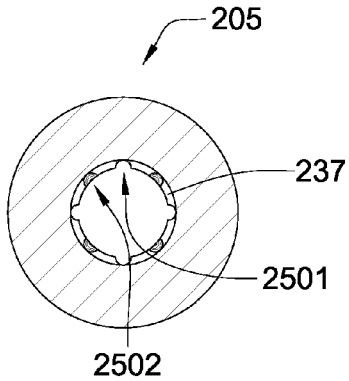
FIG. 27 is a cross-sectional diagram of another embodiment of a pick.
Figure 28:
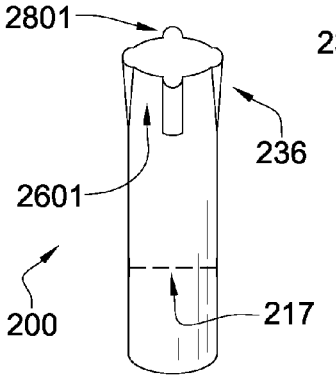
FIG. 28 is a perspective diagram of another embodiment of a rear portion of a pick.

FIGS. 25-33 disclose various embodiments of carbide bolsters 205 and rear portions 200. Referring now to FIGS. 25-26, FIG. 25 is a cross-section of a carbide bolster 205. The inwardly protruding catch 237 of the carbide bolster 205 may form a pass slot 2501. In FIG. 25 the inwardly protruding catch 237 forms a plurality of pass slots 2501. The rear portion 200 of FIG. 26 comprises a plurality of radially extending catches 236. Each radially extending catch 236 forms an adjacent slot 2601. The radially extending catch 236 of the rear portion 200 of FIG. 26 is adapted to pass through the pass slot 2501 of the inwardly protruding catch 237 of the carbide bolster 205 of FIG. 25 to allow the first end 201 of the rear portion 200 to enter the cavity 203 of the carbide bolster 205. The rear portion 200 may then be rotated about its central axis 403 and the radially extending catch 236 may be lowered into a hook slot 2502 of the inwardly protruding catch 237. The catches 236, 237 may thereby interlock with one another. In FIG. 26 the radially extending catch 236 comprises a generally rectangular geometry 2602 that tapers down to the outer diameter 217 of the rear portion FIGS. 27-28 disclose an embodiment of a carbide bolster 205 comprising a plurality of pass slots 2501 and a plurality of hook slots 2502. The rear portion 200 comprises a plurality of radially extending catches 236 that are adapted to pass through the pass slots 2501 and interlock with the hood slots. In FIG. 28, each of the plurality of radially extending catches 236 comprise a generally circular geometry 2801 that tapers down to the outer diameter 217 of the rear portion.

Figure 29:
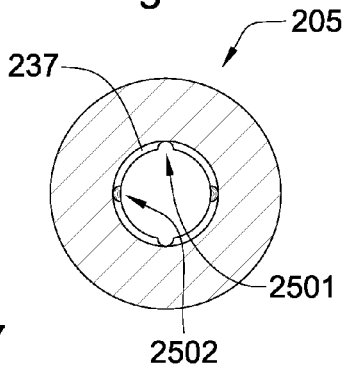
FIG. 29 is a cross-sectional diagram of another embodiment of a pick.
Figure 30:
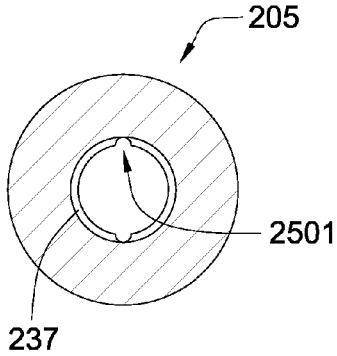
FIG. 30 is a cross-sectional diagram of another embodiment of a pick.

FIG. 29 discloses a cross-sectional view of an embodiment of a carbide bolster 205 comprising pass slots 2501 and hook slots 2502 in a different relative orientation than that shown in FIG. 27. FIG. 30 discloses an embodiment of a carbide bolster 205 comprising two pass slots 2501 and no hook slots 2501. In such embodiments the radially extending catch 236 of the rear portion 200 may rest directly on the inwardly protruding catch 237 of the cavity 203 of the carbide bolster 205.

Figure 31:
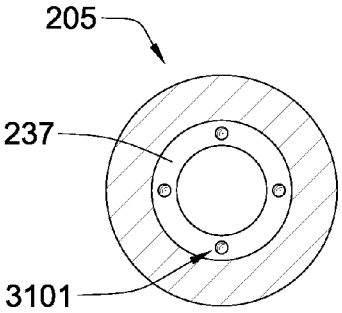
FIG. 31 is a cross-sectional diagram of another embodiment of a pick.
Figure 32:
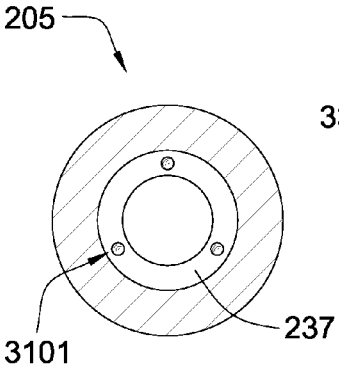
FIG. 32 is a cross-sectional diagram of another embodiment of a pick.
Figure 33:
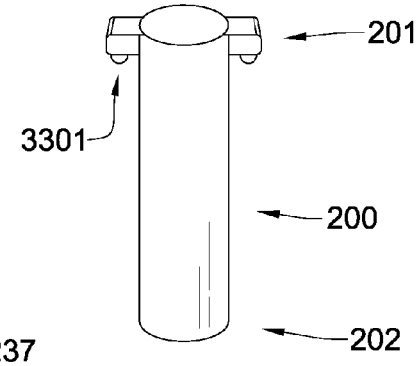
FIG. 33 is a perspective diagram of another embodiment of a rear portion of a pick.

Referring now to FIGS. 31-33, the radially extending catch 236 of the first end 201 of the rear portion is a hook 3301. The hook 3301 may be adapted to interlock with an indentation 3101 in the inwardly protruding catch 237. Interlocking the hook 3301 of the radially extending catch 236 with the indentation 3101 of the inwardly protruding catch 237 may prevent the catches 236, 237 from disengaging from one another while the rear portion 200 is being pulled by the tensioning mechanism in the direction of the second end 202 of the rear portion 200. In some embodiments, the indentation 3101 may also comprise a hook 3301. FIG. 32 discloses an embodiment of an inwardly protruding catch 237 with a different orientation of indentations 3101 from that shown in FIG. 31.

Figure 34:
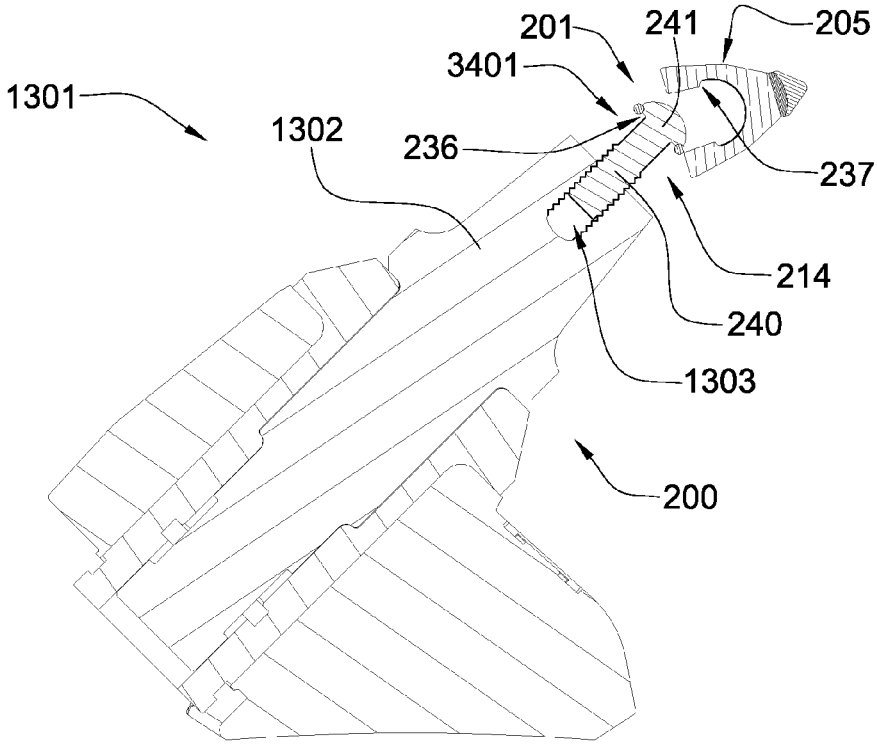
FIG. 34 is a cross-sectional diagram of an embodiment of a mining pick.
Figure 35:
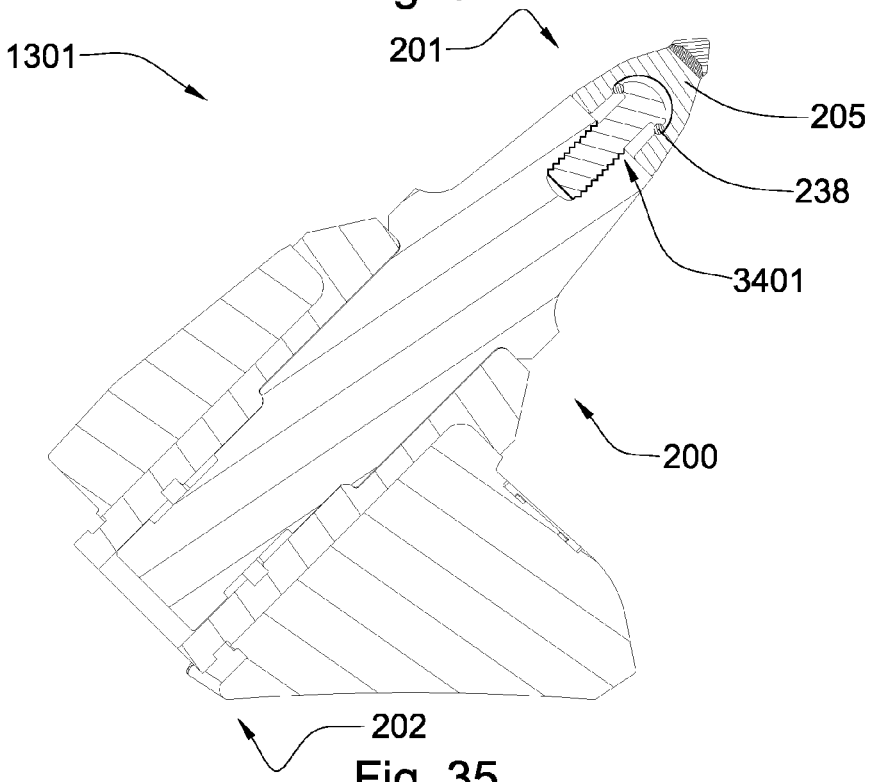
FIG. 35 is a cross-sectional diagram of another embodiment of a mining pick.

Referring now to FIGS. 34-35, the first end 201 of the rear portion 200 of a mining pick 1301 comprises a locking mechanism 214 that is a lug 3401. The lug 3401 in FIGS. 34-35 comprises a locking shaft 240 and a locking head 241. The locking shaft 240 is adapted to thread into the central recess 1303 in a steel body 1302 of a mining pick 1301. In FIG. 34, the lug 3401 is partially threaded into the recess 1303. An embodiment of a carbide bolster 205 is shown being angled onto the locking head 241 of the lug 3401. Once the bolster 205 is angled onto the locking head 241, an inwardly protruding catch 237 of the bolster 205 may interlock with a radially extending catch 236 of the lug 3401, thereby connecting the lug 3401 to the bolster 205. Once the lug 3401 and bolster 205 are connected, the lug 3401 may be further threaded into the central recess 1303 of the steel body 1302.

Whereas the present invention has been described in particular relation to the drawings attached hereto, it should be understood that other and further modifications apart from those shown or suggested herein, may be made within the scope and spirit of the present invention.

What is claimed is:

1. A pick, comprising:

a front portion with an impact tip brazed to a carbide bolster;

the carbide bolster comprising a cavity formed in its base end and adapted to interlock with a rear portion of the pick such that movement of the rear portion with respect to the carbide bolster is prevented;

the rear portion being adapted to be retained within a bore of a holder attached to a driving mechanism;

the rear portion comprising a locking mechanism adapted to lock its first end within the cavity, and the locking mechanism comprises a radially extending catch formed in the first end of the rear portion.

2. The pick of claim 1, wherein the cavity comprises an inwardly protruding catch.

3. The pick of claim 2, wherein the inwardly protruding catch is adapted to interlock with the radially extending catch of the first end.

4. The pick of claim 2, wherein an insert is intermediate the inwardly protruding catch and the radially extending catch.

5. The pick of claim 4, wherein the insert is a ring.

6. The pick of claim 4, wherein the insert is a plurality of balls, wedges, or combinations thereof.

7. The pick of claim 2, wherein the inwardly protruding catch is a hook.

8. The pick of claim 2, wherein the inwardly protruding catch is a taper.

9. The pick of claim 2, wherein the inwardly protruding catch forms a slot.

10. The pick of claim 1, wherein the radially extending catch is a hook.

11. The pick of claim 1, wherein the radially extending catch is a taper.

12. The pick of claim 1, wherein the radially extending catch forms a slot.

13. The pick of claim 1, wherein the first end of the rear portion is a lug.

14. The pick of claim 1, wherein the rear portion comprises a tensioning mechanism adapted to apply a rear ward force on its first end.

15. The pick of claim 14, wherein the tensioning mechanism comprises a press fit, a taper, and/or a nut.

16. The pick of claim 1, wherein the locking mechanism comprises a wedge.

17. The pick of claim 1, wherein the impact tip comprises a diamond bonded to a carbide substrate, the diamond comprises a generally conical shape with an apex and the thickness of the diamond at the apex is 0.100 to 0.500 inches.

18. The pick of claim 17, wherein the diamond comprises a volume of 75% to 175% of the carbide substrate.

19. The pick of claim 1, wherein the rear portion is generally cylindrical.

20. The pick of claim 1, wherein an inside surface of the carbide bolster comprises a uniform inward taper.

* * * * *

UNITED STATES PATENT AND TRADEMARK OFFICE

CERTIFICATE OF CORRECTION

PATENT NO. : 7,648,210 B2
APPLICATION NO. : 11/971965
DATED : January 19, 2010
INVENTOR(S) : David R. Hall et al.

It is certified that error appears in the above-identified patent and that said Letters Patent is hereby corrected as shown below:

In the Claims

In column 11, claim 1, line 20, after "end within the cavity", replace ", and" with --; and--.

In column 11, claim 1, line 20, after "and" start a new paragraph with "the locking".

Signed and Sealed this
Third Day of April, 2012

David J. Kappos

David J. Kappos
*Director of the United States Patent and Trademark Office*